US005802417A

United States Patent [19]

Fyson

[11] Patent Number: 5,802,417

[45] Date of Patent: Sep. 1, 1998

[54] CHEMICAL SUPPLY CARTRIDGE

[75] Inventor: John Richard Fyson, Hackney, England

[73] Assignee: Eastman Kodak Company, Rochester, N.Y.

[21] Appl. No.: 558,211

[22] Filed: Nov. 17, 1995

[30] Foreign Application Priority Data

Nov. 19, 1994 [GB] United Kingdom ..... 9423380

[51] Int. Cl.[6] ..... G03D 3/02

[52] U.S. Cl. ..... 396/626; 396/630; 396/641; 222/318; 222/189.11

[58] Field of Search ..... 354/298, 354; 221/318, 464.1, 564; 346/626, 624, 630

[56] References Cited

U.S. PATENT DOCUMENTS

| | | | |
|---|---|---|---|
| 4,669,847 | 6/1987 | Taniguchi et al. | 354/324 X |
| 4,814,809 | 3/1989 | De Prijcker et al. | 396/626 |
| 4,857,950 | 8/1989 | Takase et al. | 354/324 |
| 5,040,013 | 8/1991 | Kurokawa et al. | 354/322 |
| 5,148,208 | 9/1992 | Klosterboer et al. | 396/626 |
| 5,258,796 | 11/1993 | Patterson | 354/324 X |
| 5,289,223 | 2/1994 | Woog | 354/324 |
| 5,289,932 | 3/1994 | Twist | 354/324 |

FOREIGN PATENT DOCUMENTS

| | | |
|---|---|---|
| 0 566 181 A1 | 10/1993 | European Pat. Off. . |
| 0 608 947 | 8/1994 | European Pat. Off. . |
| 2 695 218 | 3/1994 | France . |
| 4-16844 | 1/1992 | Japan . |
| 4-115252 | 4/1992 | Japan . |
| 2132635 | 7/1984 | United Kingdom . |
| 92/22853 | 12/1992 | WIPO . |

*Primary Examiner*—D. Rutledge
*Attorney, Agent, or Firm*—Frank Pincelli

[57] ABSTRACT

It is known to supply processing chemicals for photographic processing apparatus in chemical supply cartridges. These cartridges may include ion-exchange resins for cleaning wash solutions therein before they are delivered to the processing apparatus. However, efficient use of such resins is not always made. Described herein is a method and apparatus which improves the efficiency of use of ion-exchange resins in the wash solution compartment of a chemical supply cartridge.

12 Claims, 3 Drawing Sheets

CHEMICAL SUPPLY CARTRIDGE

FIELD OF THE INVENTION

The present invention relates to chemical supply cartridges and is more particularly concerned with such cartridges which include replenishment and/or clean-up chemistry for use with photographic processes and processing apparatus for carrying out such processes.

BACKGROUND OF THE INVENTION

It is known that chemicals can be supplied in the form of mixed solutions to photographic processing apparatus. These solutions may be provided in a cassette or cartridge to facilitate easy handling. Stabilizer/wash solutions may also be provided in such a cartridge.

In a photographic process, it is desirable to reduce the amount of materials used. This can be usefully achieved by chemically cleaning the solutions chemically to remove unwanted materials which have a deleterious effect on the final product.

It is known in photographic processing to provide chemistry which 'cleans up' the solutions used in these processes. GB-A-2 132 635 discloses a process for regenerating photographic fixing agents. The process comprises carrying out electrolysis on silver thiosulphate so that the silver can be recovered and the thiosulphate returned to solution. This solution is then passed through ion-exchange cartridges to remove bromide ions. The regenerated fixing agent is either recycled directly to the fixing trough of the film processing apparatus or passed to a storage tank.

Clean-up chemistry can be provided in combination with replenishment chemistry in a single cartridge or cartridge unit. One such unit is described in our co-pending European patent application no. 94 200 157.9. This unit comprises a plurality of compartments each of which contains replenishment chemistry and/or clean-up chemistry. Each compartment is connectable to an appropriate stage of suitable processing apparatus.

It is known to use resins to remove unwanted components from wash water. A method for removing such components is described in our published European patent application EP-A-0 566 181. Here, a method of processing a photographic material is disclosed in which the wash water or stabilizer solution is treated with an absorbing agent to reduce the amount of retained developing agent substantially present in the solution. The use of absorbing agents such as an activated carbons, particularly activated charcoal, and ion-exchange resins, particularly cationic resins, is described.

PROBLEM TO BE SOLVED BY THE INVENTION

Although ion-exchange resins can be used in the wash or stabilizer solutions, particularly in the final wash stage of a multi-stage washing process, it has been found that the water or other solution to be treated tries to take the shortest path through the resin. This results in inefficient use of the resin and unwanted material builds up prematurely in the wash water or solution in the final wash stage.

One particular problem occurs due to high levels of iron in the wash water of the final wash stage even though the amount of resin incorporated therein should have been sufficient to remove the iron ions expected to be present. These high levels lead to instability and staining of the final product.

SUMMARY OF THE INVENTION

It is therefore an object of the present invention to provide an improved clean-up arrangement in which the iron levels in the final wash stage are substantially reduced. In particular, the wash water or solution to be treated is forced through all of an ion-exchange resin.

In accordance with one aspect of the present invention, there is provided a method of supplying processing chemistry to an appropriate stage of photographic processing apparatus, at least one of the processing solutions passing through cleaning means to remove unwanted materials prior to entering the processing apparatus, characterized in that the cleaning means is confined so that the solution passes through a substantial volume thereof.

In accordance with another aspect of the present invention, there is provided a chemical supply cartridge for supplying processing solutions to a photographic process, the cartridge comprising a plurality of compartments each containing processing solution for the photographic process, at least one compartment containing cleaning means for cleaning up the processing solution therein;

characterized in that the cleaning means is confined within a given volume within the at least one compartment, the solution to be cleaned being forced to pass through the cleaning means.

ADVANTAGEOUS EFFECT OF THE INVENTION

By this arrangement, the amount of ion-exchange resin used to treat the wash water or solution is substantially reduced as more efficient use is made of the ion-exchange resin. Alternatively, for a given amount of resin, there would no need to change the resin as often as presently required.

Furthermore, the concentration of unwanted materials, particularly iron, in the final wash water or solution is reduced making the washed product more stable.

BRIEF DESCRIPTION OF THE DRAWINGS

For a better understanding of the present invention, reference will now be made, by way of example only, to the accompanying drawings in which.

DETAILED DESCRIPTION OF THE INVENTION

The present invention will be described with reference to a particular embodiment of a cartridge unit incorporating an ion-exchange resin in the final wash stage and comparative experiments carried out using such a cartridge unit and a cartridge unit of the prior art.

Figure 1:
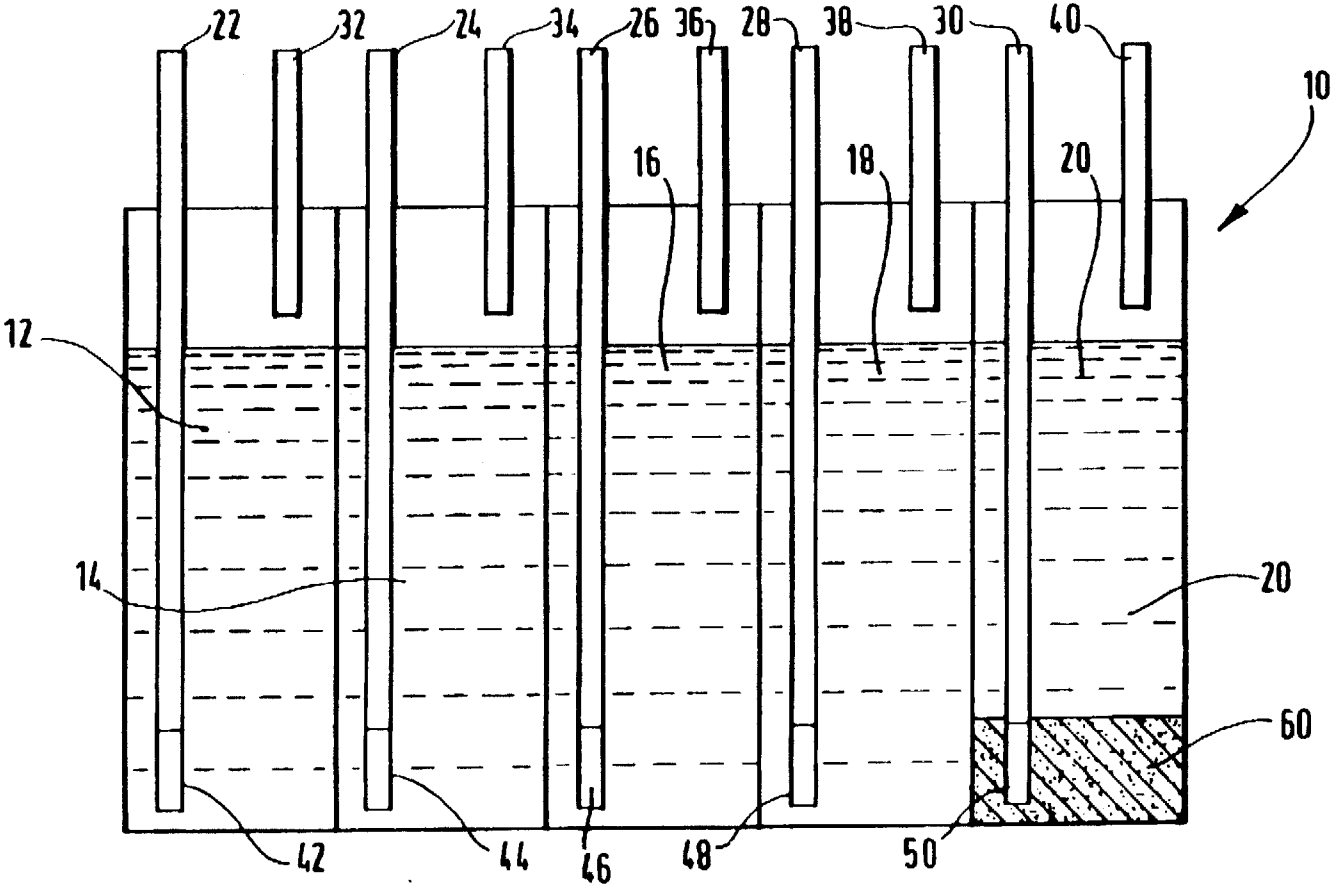
Fig.1 (PRIOR ART)
FIG. 1 illustrates a schematic diagram of a combined replenishment/clean-up cartridge unit incorporating an ion-exchange resin in accordance with the prior art.

FIG. 1 illustrates a combined replenishment/clean-up unit 10 in accordance with the prior art. The unit 10 comprises a plurality of cartridge elements 12, 14, 16, 18, 20. Each element 12, 14, 16, 18, 20 has respectively, an outlet 22, 24, 26, 28, 30 through which solution is directed to photographic processing apparatus (not shown) to which the unit 10 is connected, and an inlet 32, 34, 36, 38, 40 through which solution is returned to the unit 10 from the processing apparatus. Each outlet 22, 24, 26, 28, 30 includes a filter element 42, 44, 46, 48, 50 for filtering the solution before it is passed to the processing apparatus.

In the unit 10 shown in FIG. 1, compartment 12 contains a developer solution, compartment 14, a bleach-fix (blix) solution, and compartments 16, 18, 20, wash water. Compartment 20 also contains an ion-exchange resin bed 60. Wash water from compartment 20 passes through the resin bed 60 prior to passing to the processing apparatus (not shown). However, only the part of the resin bed 60 adjacent the filter 50 is utilized.

Figure 2:
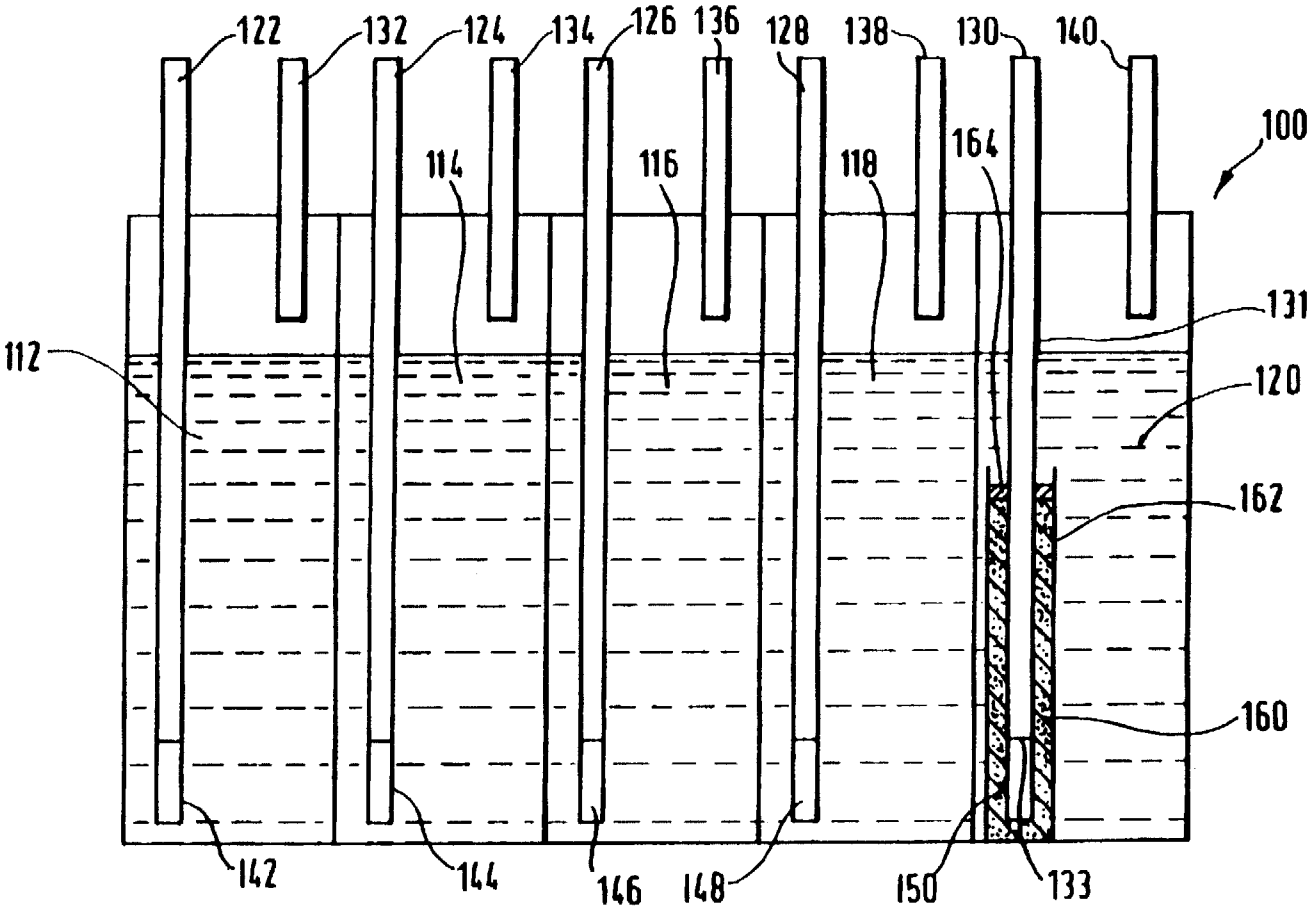
FIG. 2 illustrates a schematic diagram of one embodiment of a combined replenishment/clean-up cartridge unit incorporating an ion-exchange resin in accordance with the present invention.

FIG. 2 illustrates a unit 100 in accordance with the present invention. The unit 100 comprises a plurality of compartments 112, 114, 116, 118, 120 containing respectively a developer solution, a bleach-fix solution and wash water similar to unit 10 described above. Each compartment 112, 114, 116, 118, 120 has a respective outlet 122, 124, 126, 128, 130 and inlet 132, 134, 136, 138, 140. Filters 142, 144, 146, 148, 150 are provided on outlet connections 122, 124, 126, 128, 130 as shown. Compartment 120 includes an ion-exchange resin 160.

In this case, resin 160 is retained in a tube 162 and is not free in the bottom of compartment 120 (in comparison with unit 10 in FIG. 1). The tube 162 has a perforated cap 164 which allows tube 131 to be connected to the outlet 130 to be inserted into the resin 160. The cap 164 also allows wash water to pass into the tube 162 and through the ion-exchange resin 160 retained therein. Opening 133 of tube 131 is attached to filter 150 as shown and is directed into the bottom of the tube 162 so that the wash water must pass through the majority of the ion-exchange resin 160 retained therein before passing through filter 150 as shown, and into tube 131 and on to outlet 130.

Comparative experiments were carried out using unit 100 as shown in FIG. 2 and unit 10 (prior art) to determine the efficiency of the ion-exchange resin 160 and its use. Both units were connected, in turn, to a small volume paper processing apparatus of the type described in our published European patent application EP-A-0 592 465. The process included three wash stages.

Experiment 1.

Unit 10 was filled with fresh solutions prior to the experiment. 500 ml of solution was provided in each compartment 12, 14, 16, 18, 20. The developer solution used in compartment 12 was RA4 developer replenisher, the bleach-fix solution used in compartment 14 was RA4 NR bleach-fix and the remaining compartments 16, 18, 20 were filled with de-ionized water. 70 ml of MB6113 resin (manufactured by Rohm & Haas and supplied by BDH Chemicals Limited, Poole, Dorset, England—a mixed bed resin containing a color indicator) was added to the last wash compartment 20 and allowed to settle to the bottom of the compartment as shown in FIG. 1. This resin incorporated an indicator which changed color as the resin was spent. The liquids in the compartments 12, 14, 16, 18, 20 were circulated through the respective tanks of the processor at a rate of 50 ml/min by means of pumps.

Eighty sheets of A4 Ektacolor Supra (Registered Trade Mark) paper were processed and the iron concentration in the final wash tank water was found to be 79 ppm (parts per million). Atomic absorption spectroscopy techniques were used to carry out the iron concentration measurement.

It was also noted that, at the end of the experiment, a color change had occurred in the resin close to the connecting pipe in compartment 20 of the unit 10. This indicated that only this portion of the resin, that is, the portion adjacent the connecting pipe, had been exhausted. The color of the remainder of the resin was unchanged, indicating that that portion of the resin was not exhausted.

Experiment 2.

The experiment was repeated with fresh chemistry and MB6113 resin, as described in Experiment 1, in unit 100 according to the present invention. Again, eighty sheets of paper were processed. The iron level determined in the final wash was 6 ppm.

It was noted that during this experiment, the color of the resin gradually changed along the length of the tube away from the inlet pipe. This color change became uniform as the resin was exhausted. This uniform color change indicated that all the resin had been completely exhausted.

The result of this comparative experiment shows that there is a substantial reduction in the amount of iron remaining in the final wash and as a consequence, the possibility of staining is also much reduced.

It is to be noted that the particular resin used in the comparative experiments was chosen due to its color change properties, and it is readily understood that any suitable resin, regardless of whether it changes color on exhaustion or not, could be used in the present invention.

Figure 3:
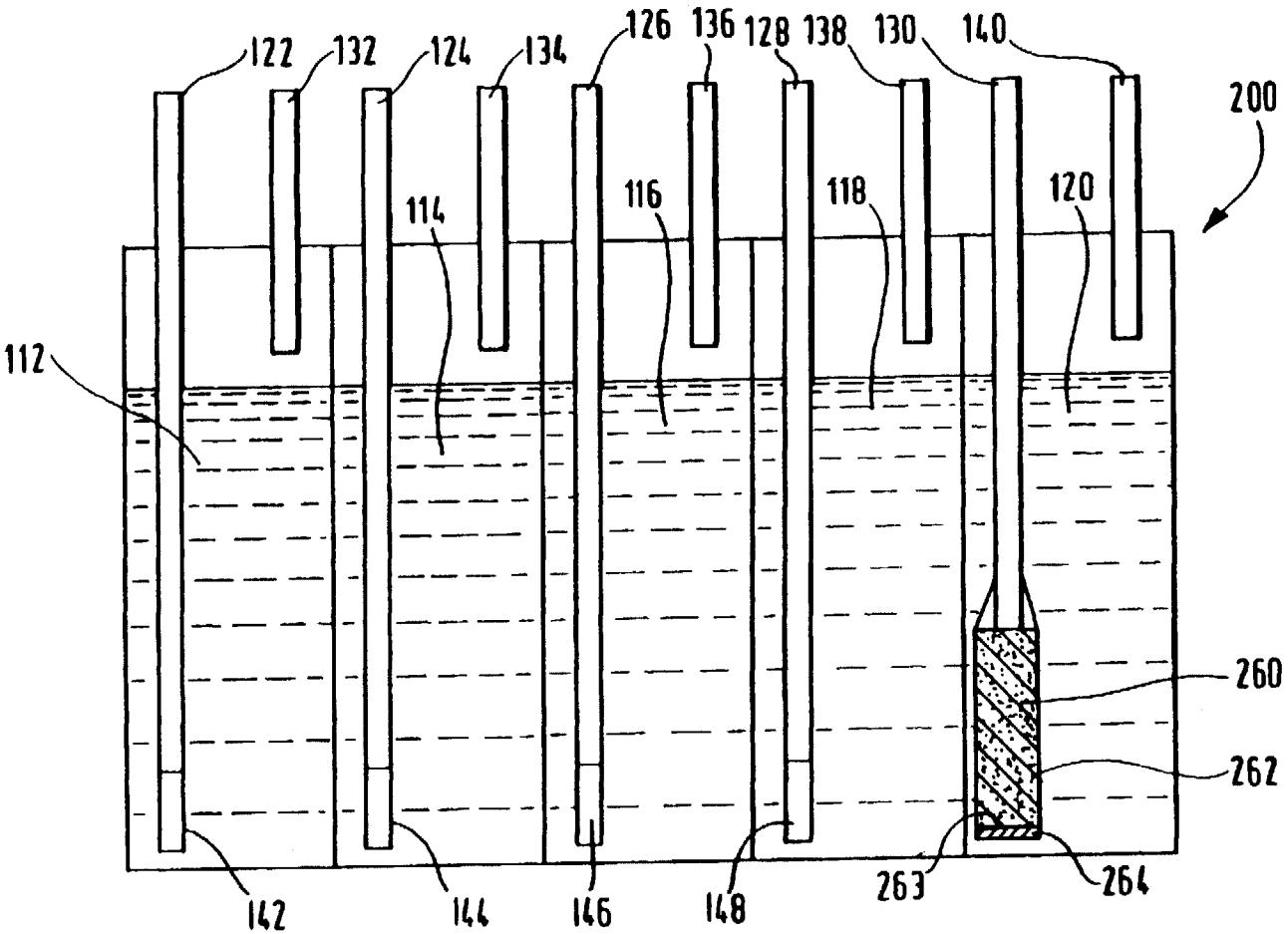
FIG. 3 is similar to FIG. 2 but illustrating a second embodiment of a combined replenishment/clean-up cartridge unit in accordance with the present invention.

FIG. 3 illustrates a unit 200 similar to that shown in FIG. 2 but having a different arrangement for the ion-exchange resin. Parts which have been previously described in FIG. 2 are reference the same. Compartment 120 includes ion-exchange resin 260 in a tube 262 having a perforated cap 264 at its lower end 263 as shown. The perforated cap 264 allows wash water to be drawn from compartment 120 through the ion-exchange resin 260 as it is passed to processing apparatus (not shown) via outlet 130. In this embodiment, there is no filter attached to the end of the outlet 130, the ion-exchange resin providing the means for filtering the wash water before it is passed to the processing apparatus.

Tube 262 was made from soft silicone rubber tubing having an internal diameter of 10 mm and an external diameter of 14 mm. The tube 262 was wound to form a flexible coil and had a length of 1m and contained 70 ml of resin as before. More than 100 sheets of paper were processed before a complete color change was obtained in the resin.

The tube 162 described in FIG. 2 could also be made of a flexible material and wound to form a flexible coil.

It can be readily understood that the clean-up arrangement of the present invention could be used with other clean-up chemistry for other processing tanks. For example, carbon can be used in the bleach/fix (blix) tank for the removal of oxidized developer.

The wash water ion-exchange resin might be separate from the cartridge unit, perhaps included in pipework connecting the chemical cartridge to the processor.

The resin could be two or more different types, unmixed but arranged so that the wash water flows through both or all of them.

Parts List:

10 . . . replenishment/clean-up unit
12,14,16,18,20 . . . cartridge elements
22,24,26,28,30 . . . outlet
32,34,36,38,40 . . . inlet
42,44,46,48,50 . . . filter element
60 . . . ion-exchange resin bed
100 . . . unit
112,114,116,118,120 . . . compartments

122,124,126,218,130 . . . outlet
131 . . . tube
133 . . . opening
132,134,136,138,140 . . . inlet
142,144,146,148,150 . . . filters
160 . . . ion-exchange resin
162 . . . tube
164 . . . perforated cap
200 . . . unit
260 . . . ion-exchange resin
262 . . . tube
263 . . . lower end
264 . . . perforated cap

I claim:

1. A method of supplying and recirculating a processing solution to an appropriate stage of a photographic processing apparatus from a chemical supply cartridge, the cartridge comprising a plurality of compartments, each compartment containing processing solution for the photographic process, at least one compartment containing cleaning means, said processing solution passing through said cleaning means to remove unwanted materials prior to entering the processing apparatus, the cleaning means being confined within the at least one compartment and is constructed so that the solution passes through a substantial volume thereof.

2. A method according to claim 1, wherein the at least one processing solution comprises a wash solution for a multi-stage wash process, the cleaning means comprising an ion-exchange resin.

3. A method according to claim 2, wherein the wash solution is for the final stage of the multi-stage wash process.

4. A method according to claim 1, wherein the cleaning means is located in an appropriate compartment of the chemical supply cartridge.

5. A method according to claim 1, wherein the cleaning means is provided in means connecting the chemical supply to the appropriate stage of the processing apparatus.

6. A chemical supply cartridge for supplying and recirculating a processing solution to a photographic process, the cartridge comprising a plurality of compartments, each containing processing solution for the photographic process, at least one compartment containing cleaning means for cleaning up the processing solution therein;

characterized in that the cleaning means is confined within a given volume within the at least one compartment and is constructed such that said solution passes through a substantial portion of said cleaning means.

7. A cartridge according to claim 6, wherein at least one compartment comprises a wash compartment, the cleaning means comprising an ion-exchange resin.

8. A cartridge according to claim 7, wherein the cleaning means is confined in a tube mounted in the at least one compartment.

9. A cartridge according to claim 8, wherein the tube is flexible.

10. A cartridge according to claim 9, wherein the tube is in the shape of a coiled spring.

11. A cartridge according to claim 7, wherein the at least one compartment is a final wash compartment for a multi-stage washing process.

12. A cartridge according to claim 6, wherein the processing solutions include replenishment solutions.

* * * * *